US011286676B2

(12) United States Patent
Nelson

(10) Patent No.: US 11,286,676 B2
(45) Date of Patent: Mar. 29, 2022

(54) TERMINATION GIRTS AND RELATED SYSTEMS AND METHODS

(71) Applicant: Knight Wall Systems, Deer Park, WA (US)

(72) Inventor: Brian Nelson, Spokane, WA (US)

(73) Assignee: Knight Wall Systems, Deer Park, WA (US)

( * ) Notice: Subject to any disclaimer, the term of this patent is extended or adjusted under 35 U.S.C. 154(b) by 0 days.

(21) Appl. No.: 16/794,628

(22) Filed: Feb. 19, 2020

(65) Prior Publication Data

US 2021/0254347 A1 Aug. 19, 2021

(51) Int. Cl.

| | |
|---|---|
| ***E04F 13/08*** | (2006.01) |
| ***E04B 1/41*** | (2006.01) |
| ***E04B 1/76*** | (2006.01) |
| *E04B 2/58* | (2006.01) |
| *E04F 13/12* | (2006.01) |

(52) U.S. Cl.

CPC ..... *E04F 13/0862* (2013.01); *E04B 1/40* (2013.01); *E04B 1/7629* (2013.01); *E04F 13/0805* (2013.01); *E04B 2/58* (2013.01); *E04F 13/12* (2013.01)

(58) Field of Classification Search

CPC .. E04B 1/40; E04B 1/7629; E04B 2/58; E04F 13/0805; E04F 13/0862; E04F 13/12

USPC ..... 52/506.06

See application file for complete search history.

(56) References Cited

U.S. PATENT DOCUMENTS

| | | | | | |
|---|---|---|---|---|---|
| 1,932,157 | A * | 10/1933 | Geraerdts | E04B 2/58 | 52/355 |
| 3,086,329 | A * | 4/1963 | Schneller | E04B 2/7457 | 52/358 |
| 3,513,613 | A * | 5/1970 | Reid | E04B 9/065 | 52/222 |
| 3,528,636 | A * | 9/1970 | Schmidt | E04B 2/58 | 248/57 |
| 3,759,007 | A * | 9/1973 | Thiele | E04F 13/0889 | 52/533 |
| 4,348,849 | A * | 9/1982 | Wollam | E04F 13/0864 | 52/545 |

(Continued)

FOREIGN PATENT DOCUMENTS

WO 2018178324 A1 10/2018

*Primary Examiner* — Brian D Mattei
*Assistant Examiner* — Joseph J. Sadlon
(74) *Attorney, Agent, or Firm* — Elevated IP, LLC

(57) ABSTRACT

Termination girts, systems incorporating termination girts, and methods of using termination girts are disclosed. The termination girts are configured to abut adjacent building systems such as windows, doors, interconnected walls and the like with a clearance close to zero, which allows exterior cladding on a structure to be hung in a seamless, smooth design without added gaps or reveals. In some embodiments, the termination girts are used, either with other types of girts or exclusively, to produce a continuous horizontal or vertical rail system on the exterior of a structure to support cladding covering the structure and, optionally, insulation mounted on the exterior of the structure. The termination girts have a high mechanical strength, are easily manufactured, allow for water drainage and air circulation, can be mounted in both horizontal and vertical orientations, and are especially useful near the intersection of perpendicular surfaces.

19 Claims, 15 Drawing Sheets

(56) References Cited

U.S. PATENT DOCUMENTS 5,226,274 A * 7/1993 Sommerstein ..... E04F 13/0805 52/509
5,529,192 A * 6/1996 Conen ..... A47B 96/028 211/187
5,606,835 A * 3/1997 Champagne ..... E04F 13/0842 52/520
5,779,333 A * 7/1998 Lautenschlager ..... A47B 88/43 312/334.14
6,098,363 A * 8/2000 Yaguchi ..... E04F 13/0801 52/385
6,817,151 B2 * 11/2004 Foderberg ..... E04C 2/06 52/309.12
6,895,721 B2 * 5/2005 Watanabe ..... E04F 13/0816 52/476
7,356,970 B1 * 4/2008 Frobosilo ..... E04B 1/08 52/261
7,677,009 B2 * 3/2010 Bowman ..... E04C 3/09 52/641
8,141,310 B2 * 3/2012 Trezza ..... E04C 2/38 52/302.3
8,191,326 B2 * 6/2012 Shapiro ..... B44C 5/0461 52/506.05
8,429,866 B2 4/2013 Knight et al.
8,596,019 B2 * 12/2013 Aitken ..... E04B 2/7457 52/710
8,726,594 B2 * 5/2014 Salazar ..... E04C 2/22 52/309.16
8,863,459 B2 * 10/2014 Holt ..... E04F 13/0803 52/509
9,091,079 B2 * 7/2015 Wright ..... E04B 1/40
9,140,008 B2 * 9/2015 Beaty ..... E04B 2/16
9,316,015 B1 * 4/2016 Elliott ..... E04H 9/14
9,347,213 B1 * 5/2016 Zhang ..... E04C 3/08
9,587,407 B2 * 3/2017 Newman ..... E04F 19/064
9,598,854 B2 * 3/2017 Ter-Borch ..... E06B 1/342
9,631,360 B2 * 4/2017 Ter-Borch ..... F16B 15/0046
9,856,655 B2 1/2018 Knight et al.
10,138,635 B1 * 11/2018 Yeo ..... E04F 13/142
10,221,574 B2 * 3/2019 Krause ..... E04B 1/7629
10,619,354 B1 * 4/2020 Simonsen ..... E04C 2/22 52/309.16
11,098,479 B2 * 8/2021 Amend ..... E04B 2/7457 52/710
2006/0213142 A1 * 9/2006 Albracht ..... E04D 13/158 52/543
2013/0291465 A1 11/2013 Resso
2018/0283013 A1 10/2018 Diercks et al.

* cited by examiner

TERMINATION GIRTS AND RELATED SYSTEMS AND METHODS

CROSS-REFERENCE TO RELATED APPLICATIONS

None.

BACKGROUND

The present disclosure generally relates to building materials and construction methods. For example, where cladding panels are attached to the structural frame of a building to form a non-structural façade, girts are often used to anchor the cladding panels to the building structure and to form an air gap that allows for drainage and evaporation of moisture. The girts are typically installed in a vertical orientation to provide adequate drainage because traditional horizontally oriented girts can limit drainage and impede drying of the wall cavity behind the cladding. However, lateral spacing of vertically oriented girts is relatively inflexible because it is determined by the location and spacing of studs, in most cases. This not only limits construction flexibility but it localizes stress and strain loads on one or a few studs, which increases the chance of a system failure.

In addition, it is often difficult to anchor cladding near a corner formed by window frames, door jams, interconnected walls and the like. One option is to use a hat girt and cover the resulting gap with a trim piece. This option requires additional labor and material. As an alternative, one flange of a hat girt might be cut from the girt to allow it to sit flush with the perpendicular surfaces. Of course, cutting the girt decreases its structural integrity. Thus, both of these options suffer from drawbacks.

Several girts have been developed in an attempt to address these issues. For example, U.S. Pat. No. 8,429,866 discloses several box girts and J-channels, and U.S. Pat. No. 9,856,655 and Pub. Nos. WO2018/178324, US2018/0283013 and US2013/0291465 describe hat girts intended to improve drainage and air circulation. However, none of these devices is optimized for mechanical strength, ease of manufacture, water drainage, air circulation, and mounting orientation.

SUMMARY

The present invention provides termination girts, systems incorporating termination girts, and methods of using termination girts. The disclosed termination girts are configured to abut adjacent building systems such as windows, doors, interconnected walls and the like with a clearance close to zero, which allows exterior cladding on a structure to be hung in a seamless, smooth design without added gaps or reveals. In some embodiments, the present termination girts are used, either with other types of girts or exclusively, to produce a continuous horizontal or vertical rail system on the exterior of a structure to support cladding. The termination girts have a high mechanical strength, are easily manufactured, allow for water drainage and air circulation, can be mounted in both horizontal and vertical orientations, and are especially useful near the intersection of perpendicular surfaces.

In an aspect, a termination girt comprises a box girt having a body comprising a front wall, a back wall, a first side wall connecting the front wall and the back wall, and a second side wall extending from the front wall toward the back wall, wherein the back wall and the second side wall are separated by a longitudinal gap and a flange that is coplanar with the back wall, wherein the flange extends from an edge of the second side wall away from the body of the box girt.

In an embodiment, the box girt is a substantially rectangular box girt. In an embodiment, the box girt is substantially a parallelogram, for example, the box girt may be substantially rectangular, substantially square or substantially rhombohedral. In an embodiment, the box girt is a quadrilateral having one or more walls that is/are non-parallel with an opposite wall(s). A box girt comprising a longitudinal gap may be referred to herein as "an open box girt".

In an embodiment, the front wall and the back wall are substantially parallel to one another. In an embodiment, the first side wall and the second side wall are substantially parallel to one another. In an embodiment, the first side wall and the second side wall are substantially parallel to one another and substantially perpendicular to the front wall and the back wall.

In an embodiment, the back wall is shorter than the front wall.

In an embodiment, the first side wall and/or the second side wall have/has a length between 0.5 inches and 6 inches, or between 0.5 inches and 3 inches, or between 0.6 inches and 2.5 inches, or between 0.7 inches and 1.5 inches.

In an embodiment, the overall height of the termination girt is between 2 inches and 12 inches, or between 2.5 inches and 8 inches, or between 3 inches and 6 inches, or between 3.5 inches and 4.5 inches.

In an embodiment, a termination girt is contiguous and made of a material selected from the group consisting of steel, stainless steel, carbon fiber, aluminum, plastic, fiber reinforced polymer (e.g., fiberglass) and combinations thereof.

In an embodiment, the longitudinal gap extends the entire length of the termination girt. In an embodiment, the longitudinal gap has a height greater than or equal to 0.5 inches, or greater than or equal to 0.65 inches, or greater than or equal to 0.75 inches, or greater than or equal to 1 inch, or greater than or equal to 1.16 inches, or greater than or equal to 1.25 inches.

In an embodiment, an exposed edge of the back wall is bent toward a center line of the girt body.

Termination girts described herein may include a plurality of holes that allow water and moisture to escape the system and/or that reduce the amount of material or weight of the termination girt. In an embodiment, the front wall and the back wall comprise at least partially aligned holes. In an embodiment, the termination girt further comprises holes within the front wall, which optionally extend into the first side wall. In an embodiment, the termination girt further comprises elongated holes within the back wall. In an embodiment, the first side wall and the second side wall comprise at least partially aligned holes. In an embodiment, a flange comprises a plurality of holes. In an embodiment, the holes are elongated or slotted holes.

In an embodiment, a terminal edge of a flange is bent toward a center line of a girt body.

In an aspect, a system for cladding an exterior wall of a structure and insulating the structure wall comprises plural horizontal girts fastened to the structure wall in spaced horizontal array, thermally insulating material positionally maintained adjacent the structure wall by the horizontal girts and exterior cladding for the structure supported by the horizontal girts, wherein at least one of the plural horizontal girts is a termination girt as described herein.

In an embodiment, the exterior cladding is fastened directly or indirectly to the horizontal girts. In an embodiment, the horizontal girts are attached to plural vertical girts. In an embodiment, at least one of the plural vertical girts is a termination girt as described herein.

In an embodiment, a system provides a continuously insulated wall assembly that satisfies the ASHREA 90.1 definition for continuous insulation. In an embodiment, insulation is disposed between an exterior wall of a structure and a termination girt. In such a configuration, generally only fasteners attaching the termination girt to the exterior wall penetrate the insulation, thereby providing a continuously insulated system.

In an aspect, a system for cladding an exterior wall of a structure and insulating the structure wall comprises plural girts fastened to the structure wall in spaced array, thermally insulating material positionally maintained adjacent the structure wall by the girts, and exterior cladding for the structure supported by plural girts, wherein at least one of the plural girts is a termination girt as described herein. In an embodiment, the plural girts are vertical, horizontal or both vertical and horizontal.

In an embodiment, the plural girts are horizontal girts. In an embodiment, the system further comprises plural vertical girts, in spaced vertical array, that are disposed between the thermally insulating material and the plural horizontal girts. In an embodiment, at least one of the plural vertical girts is a termination girt as described herein.

In an aspect, a method of using a termination girt comprises placing a termination girt described herein with the back wall and the first side wall of the termination girt abutting substantially perpendicular surfaces and applying fasteners through holes of the flange and/or the back wall into one of the substantially perpendicular surfaces.

In an aspect, a kit comprises one or more of the termination girts disclosed herein, instructions for using of the termination girt(s), and optionally one or more fasteners. In an embodiment, a kit further comprises additional girts, which are not termination girts.

BRIEF DESCRIPTION OF THE DRAWINGS

Illustrative embodiments of the present invention are described in detail below with reference to the attached drawings, wherein.

DETAILED DESCRIPTION

In general, the terms and phrases used herein have their art-recognized meaning, which can be found by reference to standard texts, journal references and contexts known to those skilled in the art. The following definitions are provided to clarify their specific use in the context of this description.

A "device" is a combination of components operably connected to produce one or more desired functions.

A "component" is used broadly to refer to an individual part of a device.

The terms "direct and indirect" describe the actions or physical positions of one component relative to another component. For example, a component that "directly" acts upon or touches another component does so without intervention from an intermediary. Contrarily, a component that "indirectly" acts upon or touches another component does so through an intermediary (e.g., a third component).

"Contiguous" refers to materials or layers that are touching or connected throughout in an unbroken sequence.

Termination girts disclosed herein may be manufactured by techniques known in the art, including, but not limited to, metal rolling, metal stamping, welding, laser cutting, CNC machining, additive manufacturing, injection molding, extruding, casting and combinations thereof.

Exemplary termination girts can be seen in FIGS. 1-6, which are described hereafter.

Figure 1A:
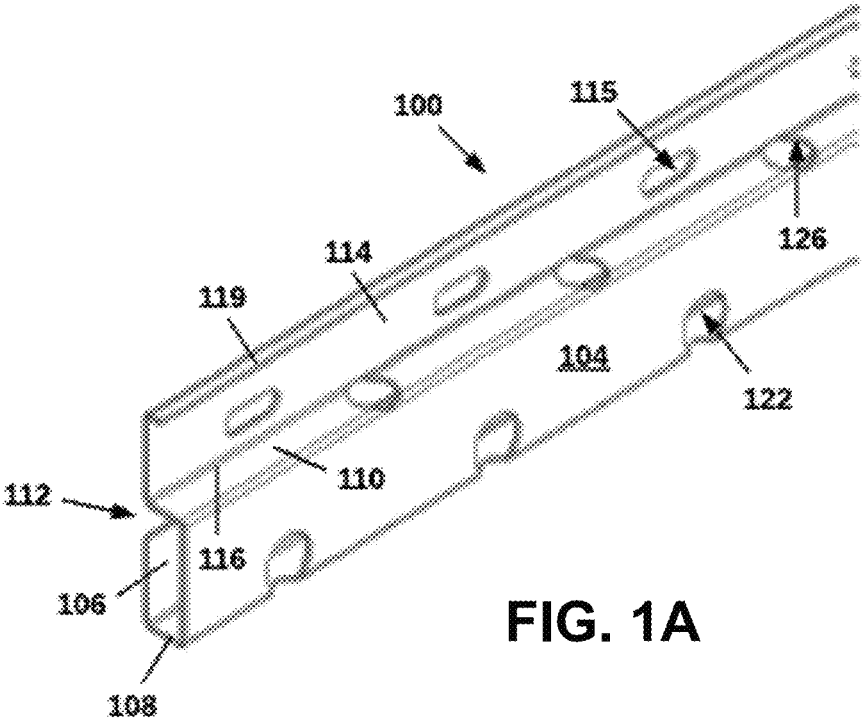
FIG. 1A provides a front perspective view of a termination girt, according to an embodiment.
Figure 1B:
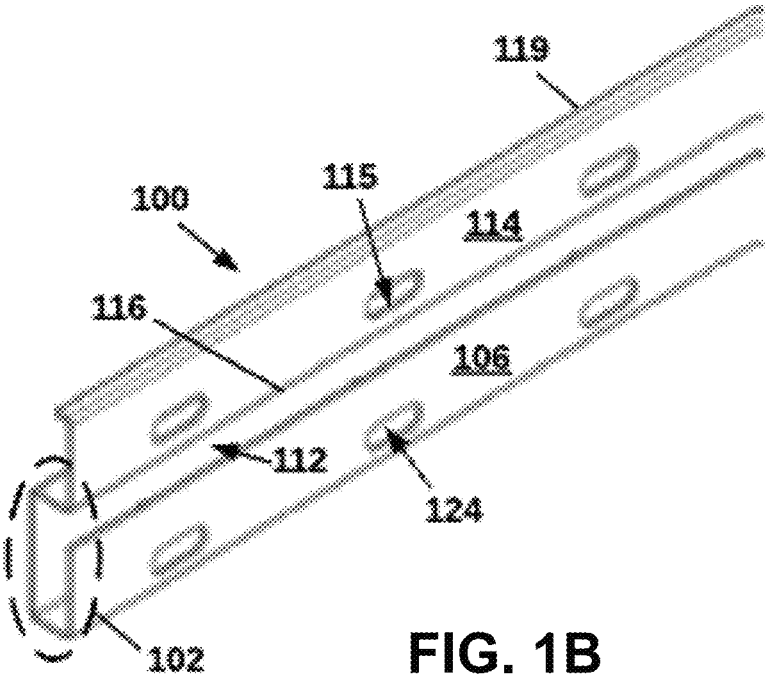
FIG. 1B provides a back perspective view of the termination girt of FIG. 1A.
Figure 1C:
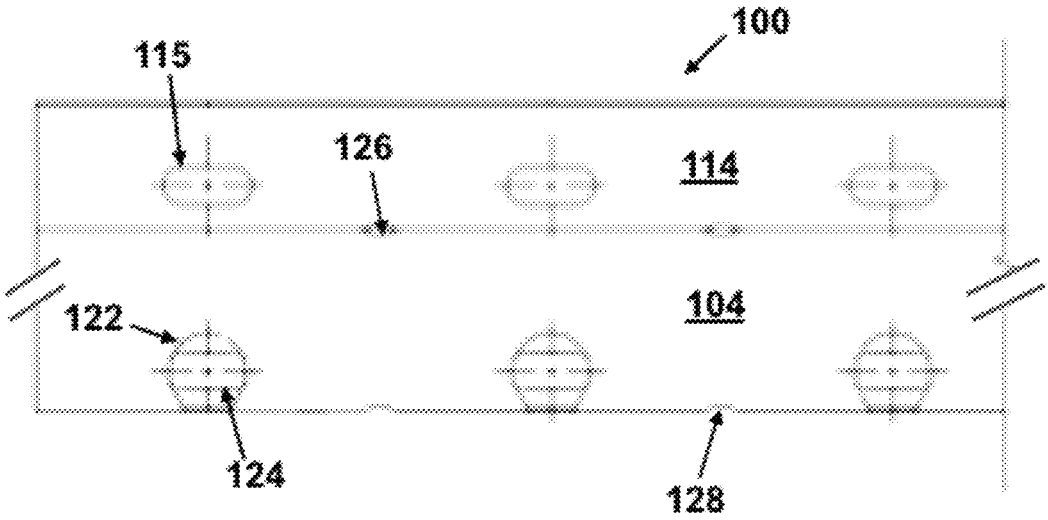
FIG. 1C provides a front plan view of the termination girt of FIGS. 1A-1B.
Figure 1D:
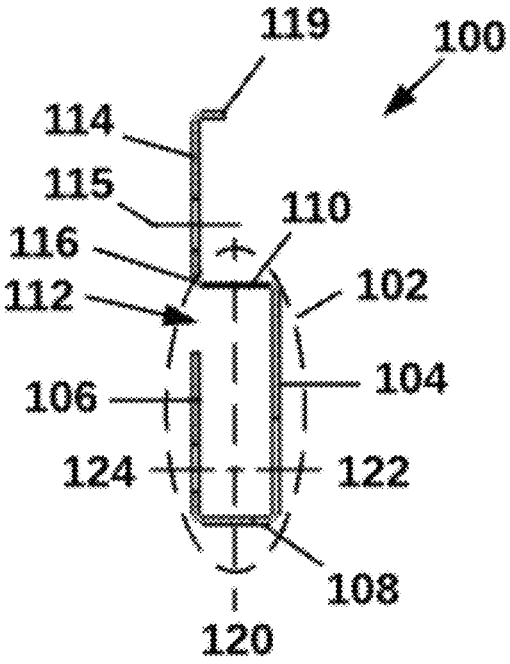
FIG. 1D provides a side plan view of the termination girt of FIGS. 1A-1C.
Figure 1E:
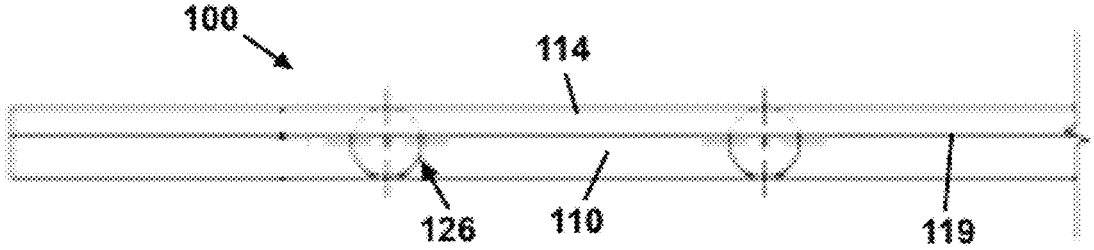
FIG. 1E provides a top plan view of the termination girt of FIGS. 1A-1D.
Figure 1F:
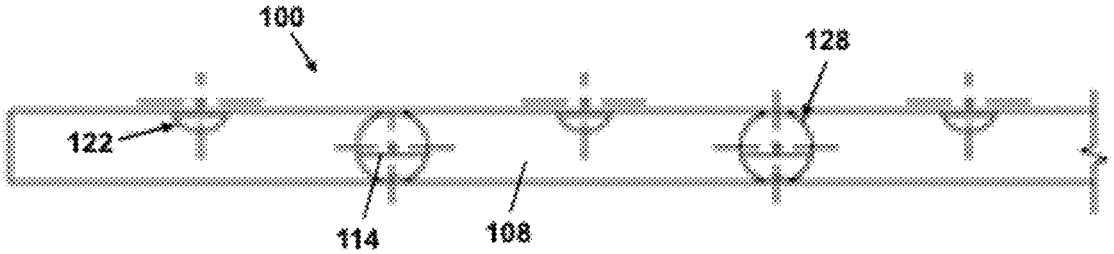
FIG. 1F provides a bottom plan view of the termination girt of FIGS. 1A-1E.

FIG. 1A provides a front perspective view of a termination girt 100; FIG. 1B provides a back perspective view of termination girt 100; FIG. 1C provides a front plan view of termination girt 100; FIG. 1D provides a side plan view of termination girt 100; FIG. 1E provides a top plan view of termination girt 100; and FIG. 1F provides a bottom plan view of termination girt 100. Termination girt 100 comprises a box girt 102 having a body comprising a front wall 104, a back wall 106, a first side wall 108 connecting front wall 104 and back wall 106, and a second side wall 110 extending from front wall 104 toward back wall 106. In the embodiment shown, box girt 102 is a substantially rectangular box girt, with back wall 106 and second side wall 110 separated by a longitudinal gap 112. A flange 114 is coplanar with back wall 106 and extends from an edge 116 of second side wall 110 away from the body of box girt 102. Optionally, a terminal edge 119 of flange 114 is bent toward a center line 120 of girt body 102.

Figure 1G:
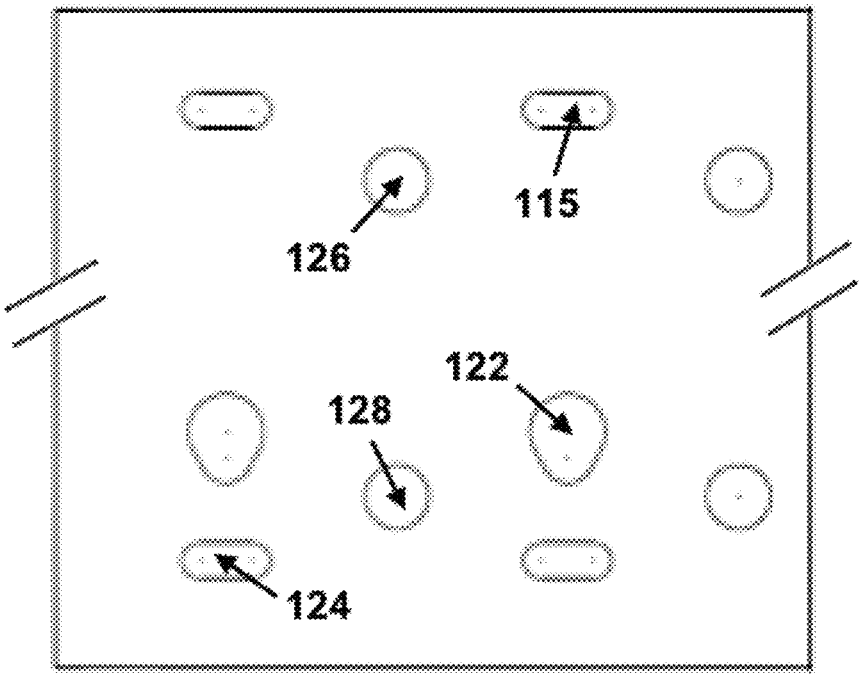
FIG. 1G provides a plan view of the material used to form the termination girt of FIGS. 1A-1F prior to folding of the material.

Termination girt 100 includes a plurality of holes that allow water and moisture to escape the system. The holes also reduce the amount of material used to produce termination girt 100, thereby decreasing material costs and weight of the final product, which may decrease manufacturing and shipping costs. In addition, holes may be used to secure the termination girt to a surface. For example, front wall 104 and back wall 106 comprise at least partially aligned holes 122, 124 for receiving a fastener. Elongated holes 124 within back wall 106 provide the function of a washer between the fastener and the surface to which the termination girt is attached. Flange 114 also comprises a plurality of holes 115, such as elongated holes, for receiving fasteners that secure termination girt 100 to the surface. As shown, holes 122 within front wall 104 extend into first side wall 108 to promote drainage when termination girt 100 is mounted horizontally. The first side wall 108 and the second side wall 110 may also comprise at least partially aligned holes 126, 128 that promote drainage. FIG. 1G provides a plan view of the material used to form termination girt 100 prior to folding of the material with the holes discussed above labeled. The presence of longitudinal gap 112 allows termination girt 100 to be formed efficiently and cost effectively using folding techniques and foregoing welding, which would typically be required to close and seal the box girt.

Figure 2A:
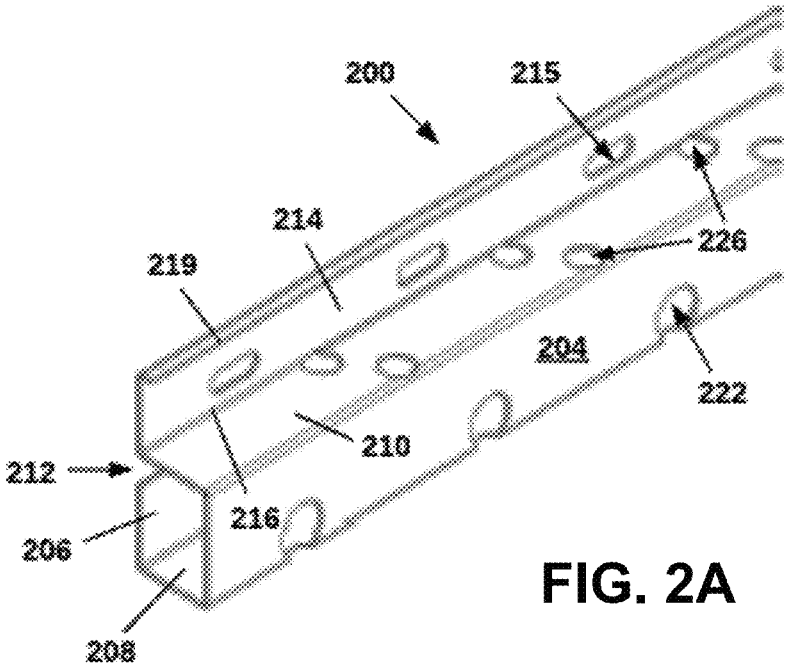
FIG. 2A provides a front perspective view of a termination girt, according to an embodiment.
Figure 2B:
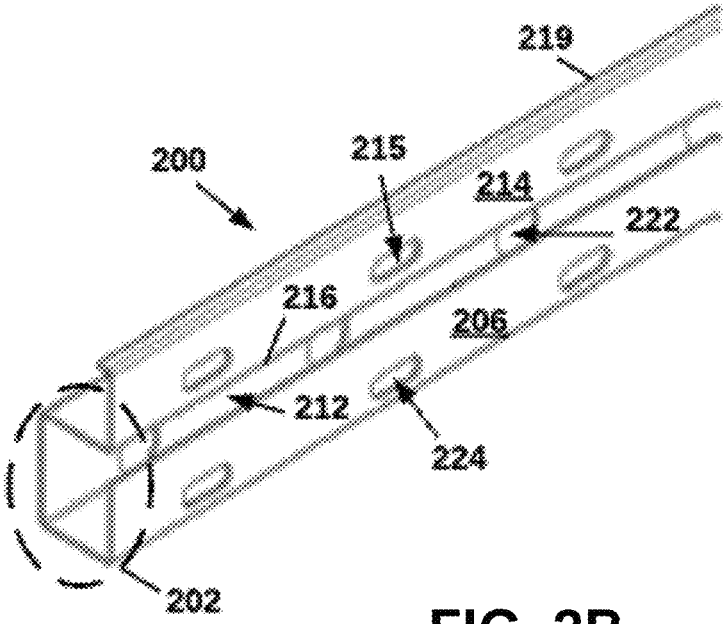
FIG. 2B provides a back perspective view of the termination girt of FIG. 2A.
Figure 2C:
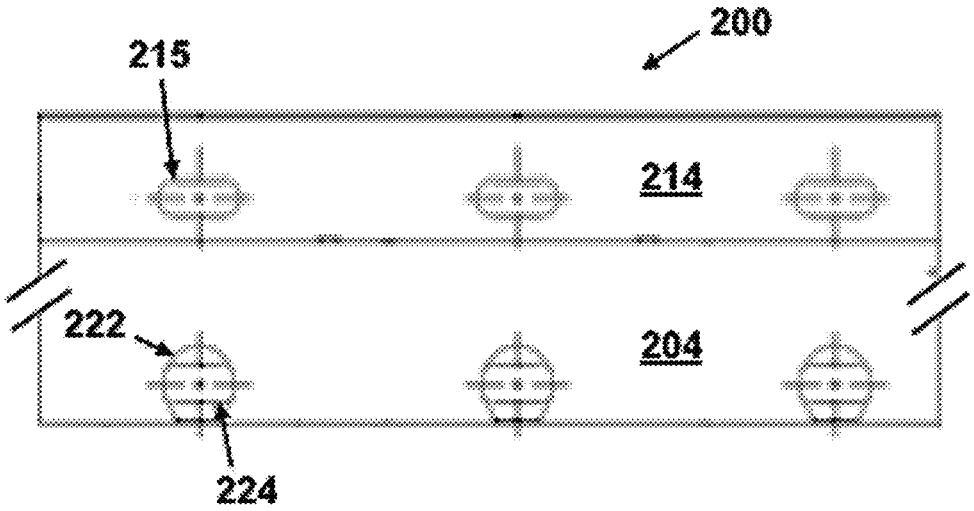
FIG. 2C provides a front plan view of the termination girt of FIGS. 2A-2B.
Figure 2D:
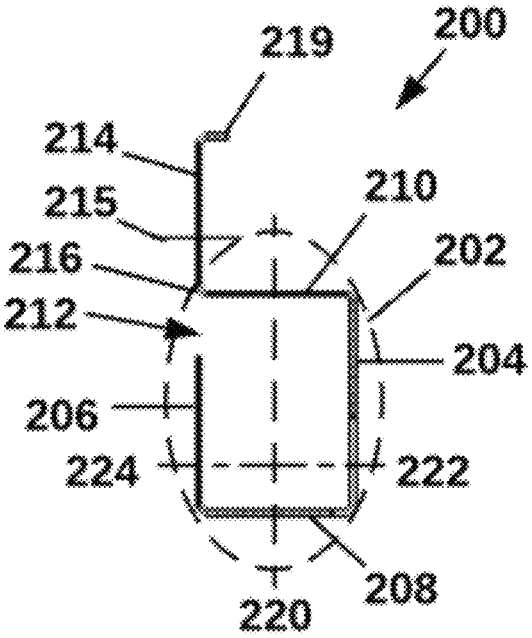
FIG. 2D provides a side plan view of the termination girt of FIGS. 2A-2C.
Figure 2E:
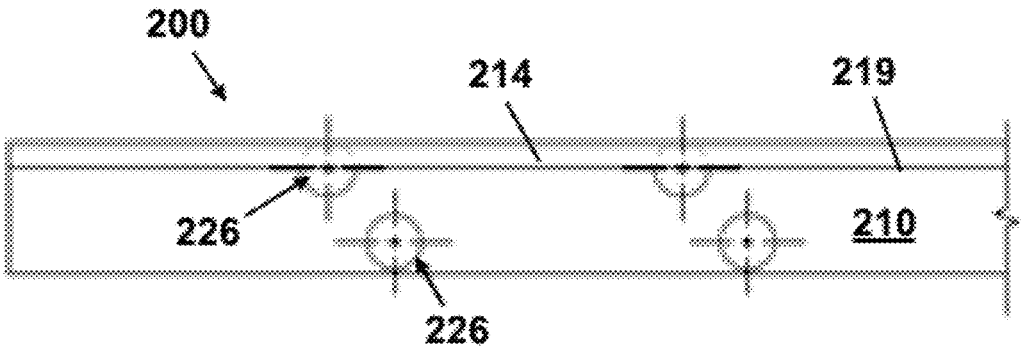
FIG. 2E provides a top plan view of the termination girt of FIGS. 2A-2D.
Figure 2F:
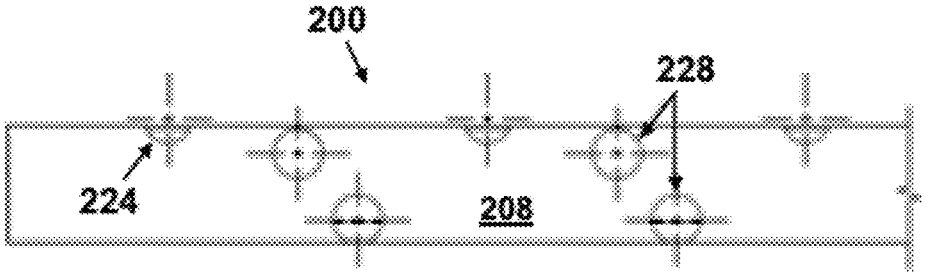
FIG. 2F provides a bottom plan view of the termination girt of FIGS. 2A-2E.

FIG. 2A provides a front perspective view of a termination girt 200; FIG. 2B provides a back perspective view of termination girt 200; FIG. 2C provides a front plan view of termination girt 200; FIG. 2D provides a side plan view of termination girt 200; FIG. 2E provides a top plan view of termination girt 200; and FIG. 2F provides a bottom plan view of termination girt 200. Termination girt 200 comprises a box girt 202 having a body comprising a front wall 204, a back wall 206, a first side wall 208 connecting front wall 204 and back wall 206, and a second side wall 210 extending from front wall 204 toward back wall 206. In the embodiment shown, box girt 202 is a substantially square box girt, with back wall 206 and second side wall 210 separated by a longitudinal gap 212. A flange 214 is coplanar with back wall 206 and extends from an edge 216 of second side wall 210 away from the body of box girt 202. Optionally, a terminal edge 219 of flange 214 is bent toward a center line 220 of girt body 202.

Figure 2G:
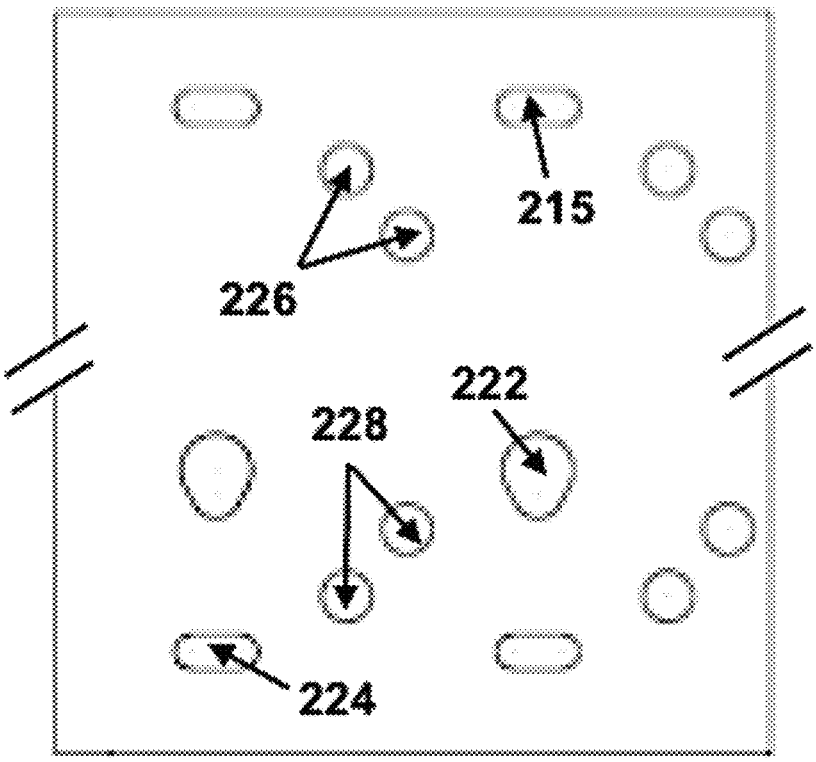
FIG. 2G provides a plan view of the material used to form the termination girt of FIGS. 2A-2F prior to folding of the material.

Termination girt 200 includes a plurality of holes that allow water and moisture to escape the system. The holes also reduce the amount of material used to produce termination girt 200, thereby decreasing material costs and weight of the final product, which may decrease manufacturing and shipping costs. In addition, holes may be used to secure the termination girt to a surface. For example, front wall 204 and back wall 206 comprise at least partially aligned holes 222, 224 for receiving a fastener. Elongated holes 224 within back wall 206 provide the function of a washer between the fastener and the surface to which the termination girt is attached. Flange 214 also comprises a plurality of holes 215, such as elongated holes, for receiving fasteners that secure termination girt 200 to the surface. As shown, holes 222 within front wall 204 extend into first side wall 208 to promote drainage when termination girt 200 is mounted horizontally. The first side wall 208 and the second side wall 210 may also comprise at least partially aligned holes 226, 228 that promote drainage. Because termination girt 200 is wider than termination girt 100, two holes are present in the first 208 and second 210 side walls, according to the present embodiment. Those of skill in the art will appreciate that 0, 1, 2 or more holes 226, 228 of equal or unequal size may be grouped together in the first 208 and second 210 side walls. FIG. 2G provides a plan view of the material used to form termination girt 200 prior to folding of the material with the holes discussed above labeled. The presence of longitudinal gap 212 allows termination girt 200 to be formed efficiently and cost effectively using folding techniques and foregoing welding, which would typically be required to close and seal the box girt.

Figure 3A:
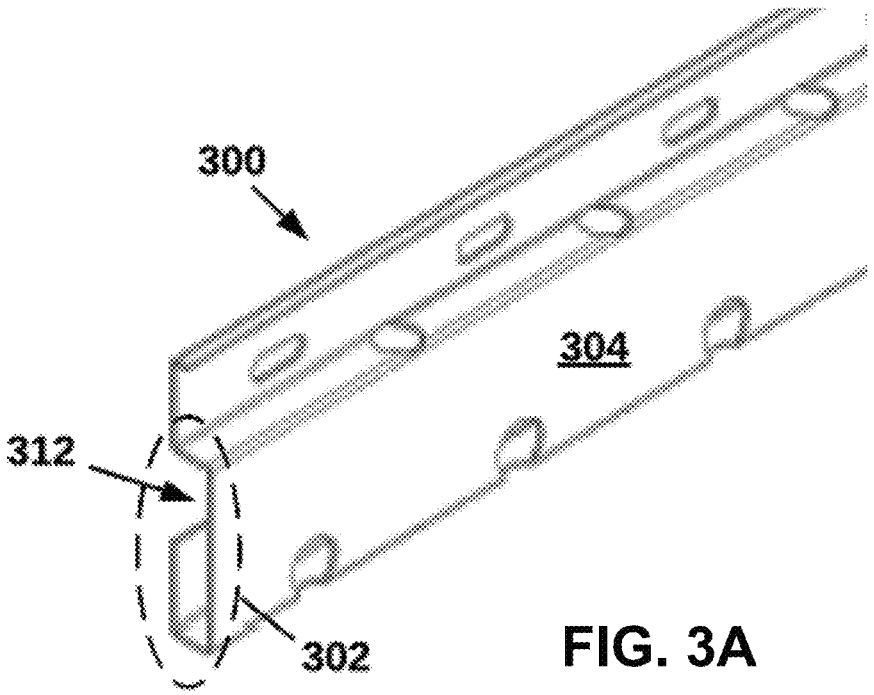
FIG. 3A provides a front perspective view of a termination girt, according to an embodiment.
Figure 3B:
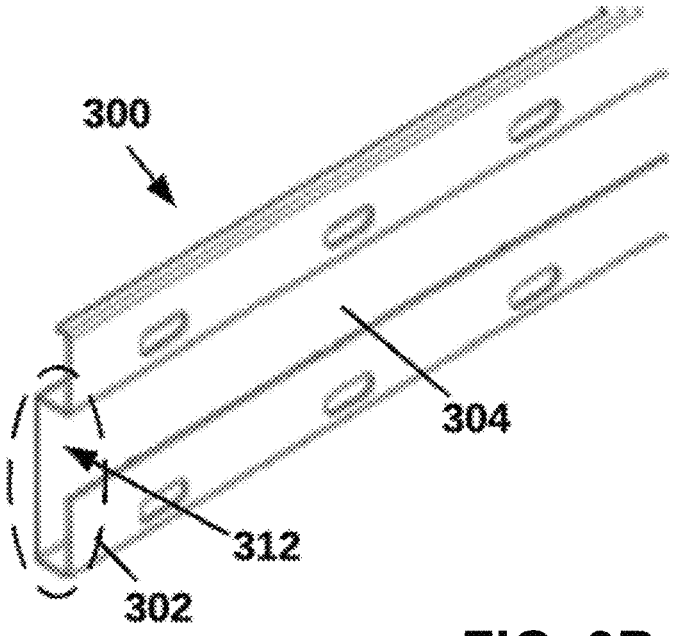
FIG. 3B provides a back perspective view of the termination girt of FIG. 3A.
Figure 3C:
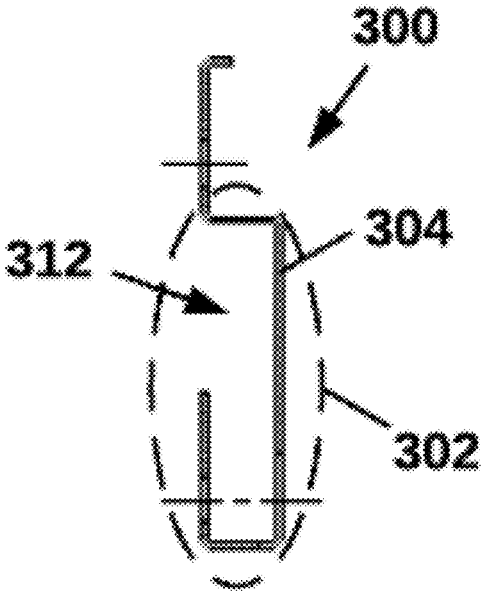
FIG. 3C provides a side plan view of the termination girt of FIGS. 3A-3B.

FIG. 3A provides a front perspective view of a termination girt 300; FIG. 3B provides a back perspective view of termination girt 300; and FIG. 3C provides a side plan view of termination girt 300. Termination girt 300 is similar to termination girt 100 because it comprises a substantially rectangular box girt 302. However, box girt 302 has a front wall 304 of greater height than front wall 104 and a longitudinal gap 312 of greater height than longitudinal gap 112. FIGS. 1C and 1E-1G are also representative of termination girt 300, the only difference being the presence of a larger amount of material between the broken sections of FIGS. 1C and 1G for termination girt 300 than for termination girt 100.

Figure 4A:
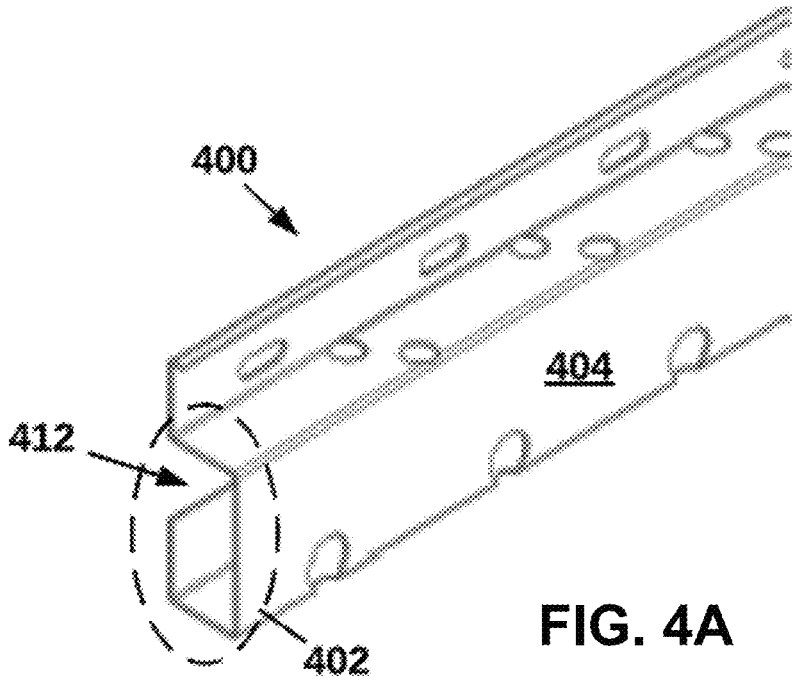
FIG. 4A provides a front perspective view of a termination girt, according to an embodiment.
Figure 4B:
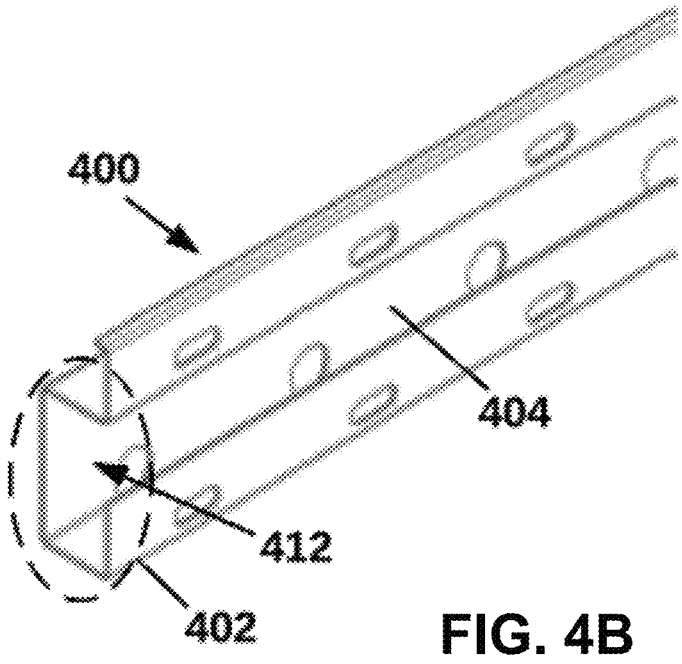
FIG. 4B provides a back perspective view of the termination girt of FIG. 4A.
Figure 4C:
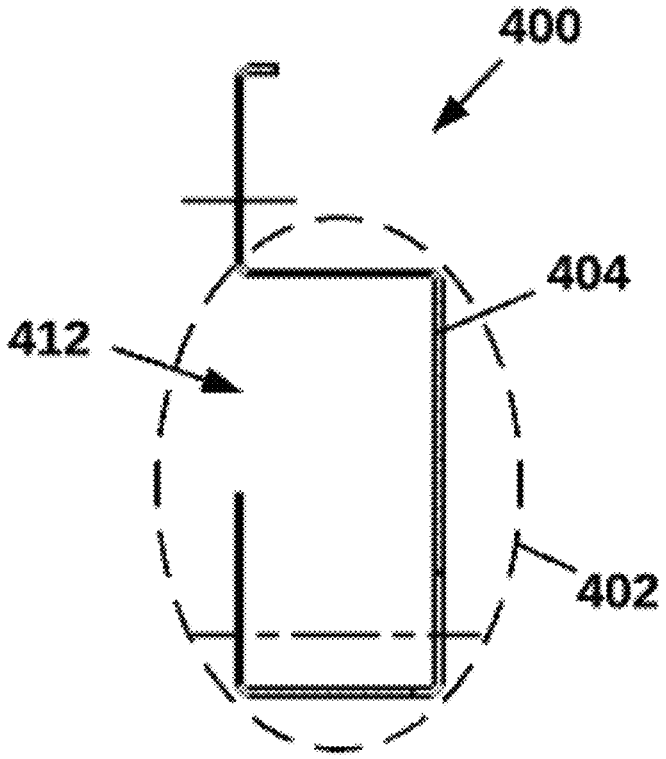
FIG. 4C provides a side plan view of the termination girt of FIGS. 4A-4B.

FIG. 4A provides a front perspective view of a termination girt 400; FIG. 4B provides a back perspective view of termination girt 400; and FIG. 4C provides a side plan view of termination girt 400. Termination girt 400 is similar in width to termination girt 200 but girt 400 forms a substantially rectangular box girt 402 with a front wall 404 of greater height than front wall 204 and a longitudinal gap 412 of greater height than longitudinal gap 212. FIGS. 2C and 2E-2G are representative of termination girt 400, the only difference being the presence of a larger amount of material between the broken sections of FIGS. 2C and 2G for termination girt 400 than for termination girt 200.

Figure 5A:
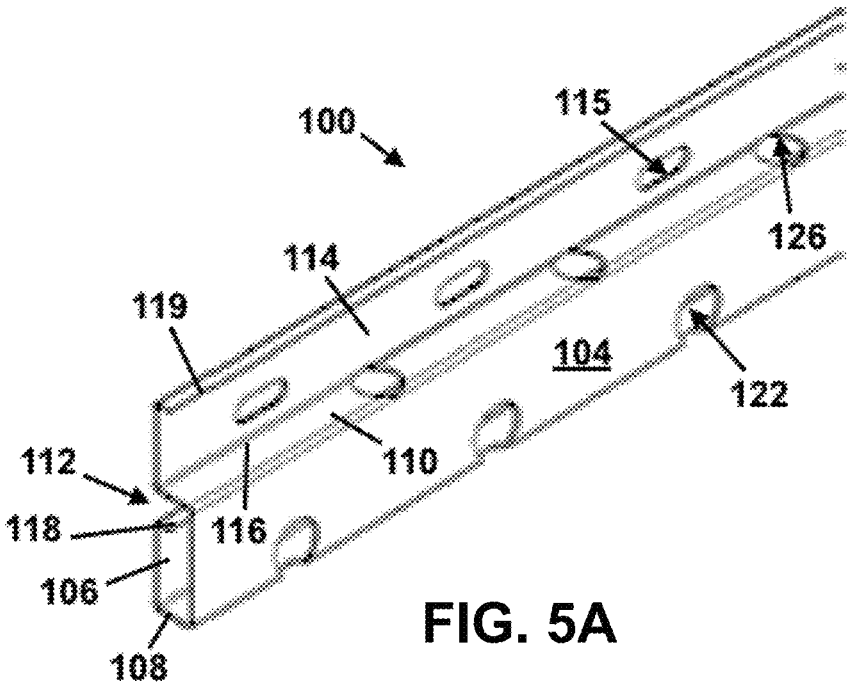
FIG. 5A provides a front perspective view of a termination girt, according to an embodiment.
Figure 5B:
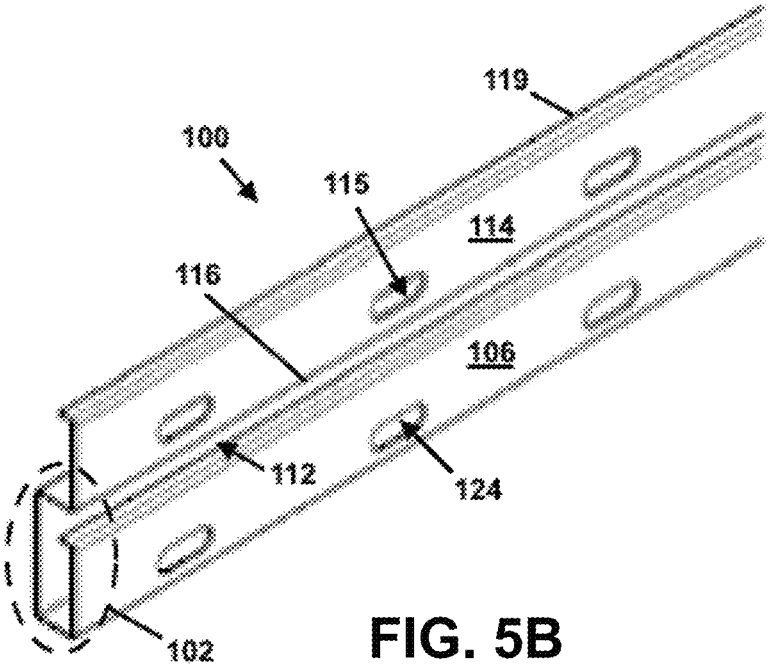
FIG. 5B provides a back perspective view of the termination girt of FIG. 5A.
Figure 5C:
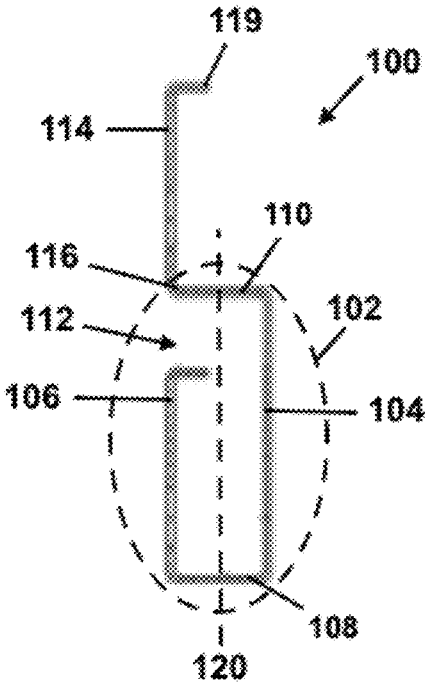
FIG. 5C provides a side plan view of the termination girt of FIGS. 5A-5B.
Figure 5D:
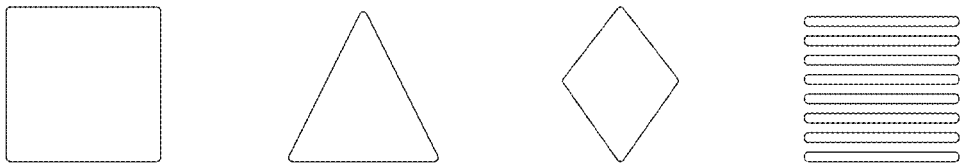
FIG. 5D provides non-limiting, exemplary hole shapes for the termination girts disclosed herein.

FIG. 5A provides a front perspective view of a slightly modified version of termination girt 100 of FIG. 1; FIG. 5B provides a back perspective view of the modified termination girt of FIG. 5A; FIG. 5C provides a side plan view of the modified termination girt of FIGS. 5A-5B. The modification shown in FIGS. 5A-5C comprises an exposed edge 118 of back wall 106 being bent toward a center line 120 of girt body 102. Those of skill in the art will appreciate that similar modifications can be made to termination girts 200, 300 and 400. Another modification that may be made to the termination girts described herein includes the use of holes having various shapes, such as the non-limiting, exemplary shapes shown in FIG. 5D (rectangular, triangular, parallelogram, series of cuts, etc.).

Figure 6:
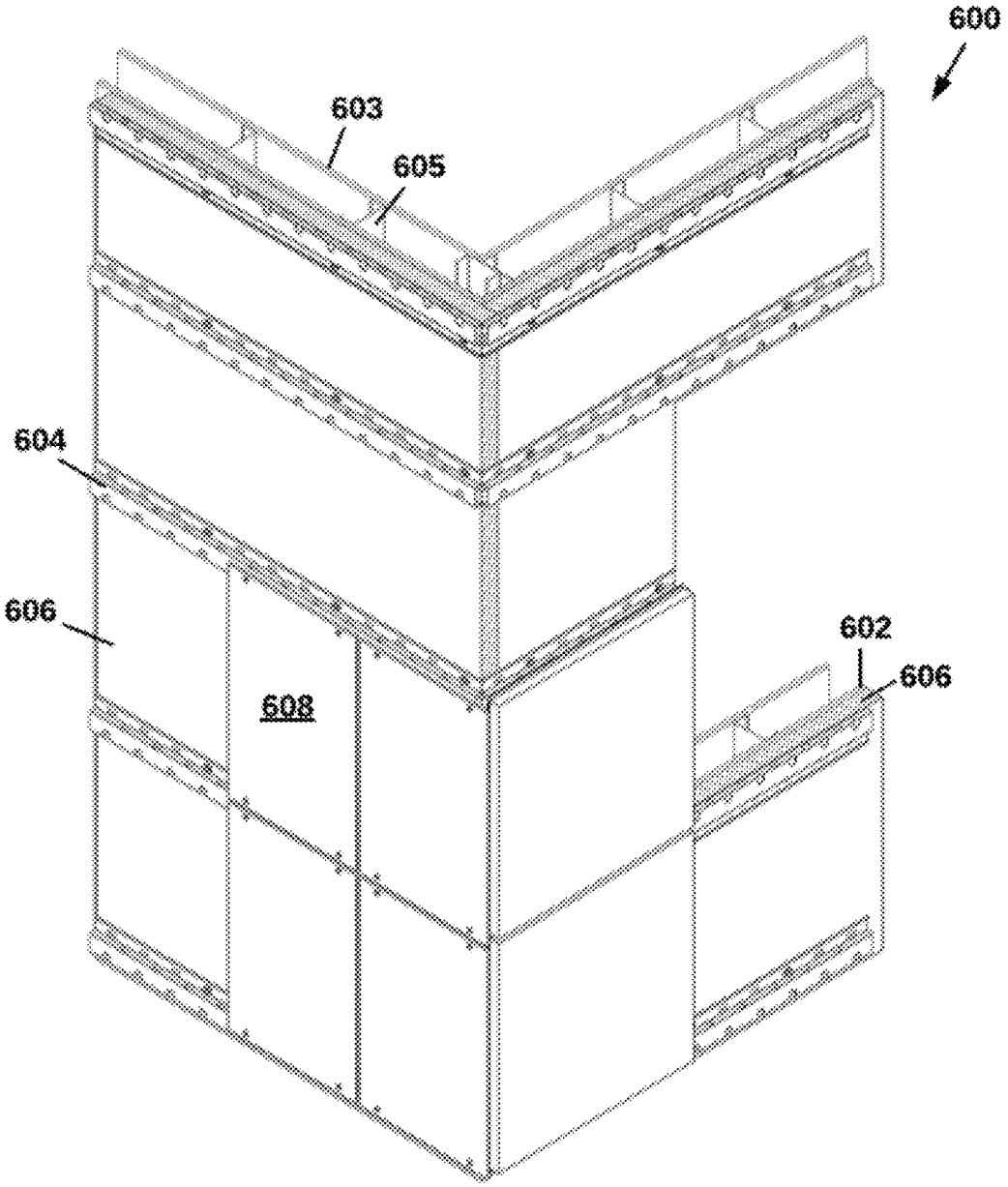
FIG. 6 provides a cutaway view of a system for cladding and insulating an exterior wall of a structure using one or more of the disclosed termination girts, according to an embodiment.

FIG. 6 provides a cutaway view of a system 600 for cladding and insulating an exterior wall 602 of a structure using one or more of the disclosed termination girts, according to an embodiment. Ordinarily, the exterior wall 602 of a structure is joined to an inner wall 603 of the structure, such as drywall, through a plurality of studs 605. System 600 comprises thermally insulating material 606 positionally maintained adjacent exterior wall 602 by plural horizontal girts 604 fastened to stud 605 or wall 602 in spaced horizontal array. In a continuously insulated system, only fasteners for securing termination girts 604 to exterior wall 602 penetrate insulation 606. Exterior cladding 608 for the structure may be supported by the plural horizontal girts 604. In such systems, at least one of the plural horizontal girts 604 may be a termination girt as described herein. Within wall systems, or elsewhere, termination girts disclosed herein are particularly useful when placed with the back wall and the first side wall of the termination girt abutting substantially perpendicular surfaces. For example, the present termination girts may be used around window frames, in corners, under overhangs, near roof lines or floor lines, and the like.

STATEMENTS REGARDING INCORPORATION BY REFERENCE AND VARIATIONS

All references cited throughout this application, for example patent documents including issued or granted patents or equivalents; patent application publications; and non-patent literature documents or other source material; are hereby incorporated by reference herein in their entireties, as though individually incorporated by reference.

The terms and expressions which have been employed herein are used as terms of description and not of limitation, and there is no intention in the use of such terms and expressions of excluding any equivalents of the features shown and described or portions thereof, but it is recognized that various modifications are possible within the scope of the invention claimed. Thus, it should be understood that although the invention has been specifically disclosed by preferred embodiments, exemplary embodiments and optional features, modification and variation of the concepts herein disclosed can be resorted to by those skilled in the art, and that such modifications and variations are considered to be within the scope of this invention as defined by the appended claims. The specific embodiments provided herein are examples of useful embodiments of the invention and it will be apparent to one skilled in the art that the invention can be carried out using a large number of variations of the devices, device components, and method steps set forth in the present description. As will be apparent to one of skill in the art, methods and devices useful for the present methods and devices can include a large number of optional composition and processing elements and steps.

When a group of substituents is disclosed herein, it is understood that all individual members of that group and all subgroups are disclosed separately. When a Markush group or other grouping is used herein, all individual members of the group and all combinations and subcombinations possible of the group are intended to be individually included in the disclosure.

It must be noted that as used herein and in the appended claims, the singular forms "a", "an", and "the" include plural reference unless the context clearly dictates otherwise. Thus, for example, reference to "a fastener" includes a plurality of such fasteners and equivalents thereof known to those skilled in the art, and so forth. As well, the terms "a" (or "an"), "one or more" and "at least one" can be used interchangeably herein. It is also to be noted that the terms "comprising", "including", and "having" can be used interchangeably. The expression "of any of claims XX-YY" (wherein XX and YY refer to claim numbers) is intended to provide a multiple dependent claim in the alternative form, and in some embodiments is interchangeable with the expression "as in any one of claims XX-YY."

Unless defined otherwise, all technical and scientific terms used herein have the same meanings as commonly understood by one of ordinary skill in the art to which this invention belongs. Although any methods and materials similar or equivalent to those described herein can be used in the practice or testing of the present invention, the preferred methods and materials are described. Nothing herein is to be construed as an admission that the invention is not entitled to antedate such disclosure by virtue of prior invention.

Whenever a range is given in the specification, for example, a range of integers, a temperature range, a time range, a composition range, or concentration range, all intermediate ranges and subranges, as well as all individual values included in the ranges given are intended to be included in the disclosure. As used herein, ranges specifically include the values provided as endpoint values of the range. As used herein, ranges specifically include all the integer values of the range. For example, a range of 1 to 100 specifically includes the end point values of 1 and 100. It will be understood that any subranges or individual values in a range or subrange that are included in the description herein can be excluded from the claims herein.

As used herein, "comprising" is synonymous and can be used interchangeably with "including," "containing," or "characterized by," and is inclusive or open-ended and does not exclude additional, unrecited elements or method steps. As used herein, "consisting of" excludes any element, step, or ingredient not specified in the claim element. As used herein, "consisting essentially of" does not exclude materials or steps that do not materially affect the basic and novel characteristics of the claim. In each instance herein any of the terms "comprising", "consisting essentially of" and "consisting of" can be replaced with either of the other two terms. The invention illustratively described herein suitably can be practiced in the absence of any element or elements or limitation or limitations which is/are not specifically disclosed herein.

All art-known functional equivalents of materials and methods are intended to be included in this disclosure. The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed. Thus, it should be understood that although the invention has been specifically disclosed by preferred embodiments and optional features, modification and variation of the concepts herein disclosed can be resorted to by those skilled in the art, and that such modifications and variations are considered to be within the scope of this invention as defined by the appended claims.

What is claimed is:

1. A termination girt comprising:

a box girt having a body comprising a front wall, a back wall, a first side wall connecting the front wall and the back wall, and a second side wall extending from the front wall toward the back wall, wherein the back wall and the second side wall are separated by a longitudinal gap, wherein the front wall and the back wall comprise at least partially aligned holes; and a flange that is coplanar with the back wall, wherein the flange extends from an edge of the second side wall away from the body of the box girt.

2. The termination girt of claim 1, wherein the box girt is a rectangular box girt.

3. The termination girt of claim 1, wherein the front wall and the back wall are substantially parallel to one another.

4. The termination girt of claim 1, wherein the first side wall and the second side wall are substantially parallel to one another.

5. The termination girt of claim 1, wherein the first side wall and the second side wall are substantially parallel to one another and substantially perpendicular to the front wall and the back wall.

6. The termination girt of claim 1, wherein the back wall is shorter than the front wall.

7. The termination girt of claim 1, wherein the longitudinal gap extends the entire length of the termination girt.

8. The termination girt of claim 1 further comprising holes within the front wall that extend into the first side wall.

9. The termination girt of claim 1 further comprising elongated holes within the back wall.

10. The termination girt of claim 1, wherein the first side wall and the second side wall comprise at least partially aligned holes.

11. The termination girt of claim 1, wherein the flange comprises a plurality of holes.

12. The termination girt of claim 11, wherein the holes are elongated holes.

13. The termination girt of claim 1, wherein a terminal edge of the flange is bent toward a center line of the girt body.

14. A system for cladding an exterior wall of a structure and insulating the structure wall, the system comprising:

plural girts fastened to the structure wall in spaced array;

thermally insulating material positionally maintained adjacent the structure wall by the plural girts; and exterior cladding for the structure supported by the plural girts;

wherein at least one of the plural girts is the termination girt of claim 1.

15. The system of claim 14, wherein the plural girts are horizontal girts.

16. The system of claim 15 further comprising plural vertical girts in spaced vertical array disposed between the thermally insulating material and the plural horizontal girts.

17. The system of claim 16, wherein at least one of the plural vertical girts is the termination girt of claim 1.

18. The system of claim 14, wherein the system provides a continuously insulated wall assembly such that only fasteners attaching the plural girts to the exterior wall penetrate the thermally insulating material.

19. A method of using a termination girt, comprising:

placing the termination girt of claim 1 with the back wall and the first side wall of the termination girt abutting substantially perpendicular surfaces; and applying fasteners through holes of the flange and/or the back wall into one of the substantially perpendicular surfaces.

* * * * *